United States Patent [19]

Takeda et al.

[11] Patent Number: 4,906,984

[45] Date of Patent: Mar. 6, 1990

[54] LIQUID CRYSTAL MATRIX DISPLAY DEVICE WITH POLARITY INVERSION OF SIGNAL AND COUNTER ELECTRODE VOLTAGES TO MAINTAIN UNIFORM DISPLAY CONTRAST

[75] Inventors: Makoto Takeda, Nara; Nobuaki Matsuhashi, Tenri; Hiroshi Take, Ikoma, all of Japan

[73] Assignee: Sharp Kabushiki Kaisha, Osaka, Japan

[21] Appl. No.: 277,398

[22] Filed: Nov. 28, 1988

Related U.S. Application Data

[63] Continuation of Ser. No. 27,892, Mar. 19, 1987, abandoned.

[30] Foreign Application Priority Data

Mar. 19, 1986 [JP] Japan ..... 61-63131

[51] Int. Cl.[4] ..... G09G 3/00

[52] U.S. Cl. ..... 340/765; 340/784; 340/805

[58] Field of Search ..... 340/765, 718, 784, 719, 340/805; 350/333, 330

[56] References Cited

U.S. PATENT DOCUMENTS

| | | | |
|---|---|---|---|
| 4,413,256 | 11/1983 | Yasuda | 340/784 |
| 4,571,585 | 2/1986 | Stein | 340/784 |
| 4,591,848 | 5/1986 | Morozumi et al. | 340/784 |
| 4,626,841 | 12/1986 | Togashi | 340/784 |
| 4,638,310 | 1/1987 | Ayliffe | 340/784 |
| 4,710,768 | 12/1987 | Takeda et al. | 340/719 |

FOREIGN PATENT DOCUMENTS

| | | |
|---|---|---|
| 0173158 | 12/1985 | European Pat. Off. . |
| 2121584 | 12/1983 | United Kingdom . |
| 2149181 | 10/1984 | United Kingdom . |
| 2139395 A | 11/1984 | United Kingdom . |
| 2139795 | 11/1984 | United Kingdom . |

*Primary Examiner*—David K. Moore
*Assistant Examiner*—M. Fatahiyar
*Attorney, Agent, or Firm*—Birch, Stewart, Kolasch & Birch

[57] ABSTRACT

A liquid crystal display device includes a plurality of scanning electrodes, a plurality of signal electrodes, and a plurality of picture element electrodes connected to intersections of scanning and signal electrodes via a plurality of switching transistors. A plurality of counter electrodes are arranged opposite to the picture element electrodes. The polarity of display signals applied to the signal electrodes is inverted for a period equal to an integer multiple of a pulse width of a scanning pulse applied to the scanning electrodes. Signals of alternating polarity are applied to the counter electrodes in synchronism with the polarity inversion of the display signals. In this way, non-uniform display contrast along the signal electrode direction of the display screen is avoided by eliminating the stray capacitance timing differences according to the position of picture element electrodes along the signal electrode direction of the display screen.

2 Claims, 6 Drawing Sheets

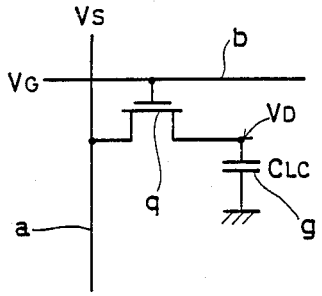
FIG.3
CONVENTIONAL ART
CONVENTIONAL ART
FIG.4(A)
FIG.4(B)
FIG.4(C)
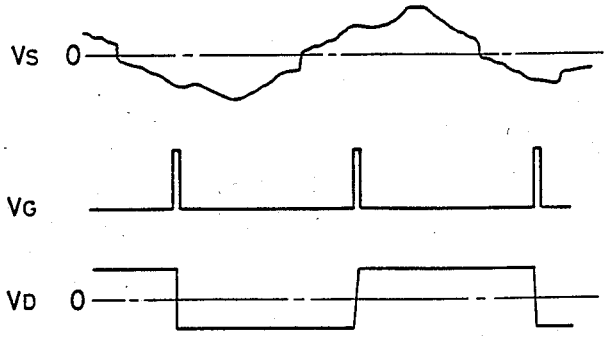

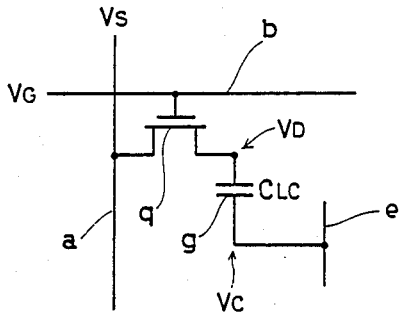
FIG.5
CONVENTIONAL ART
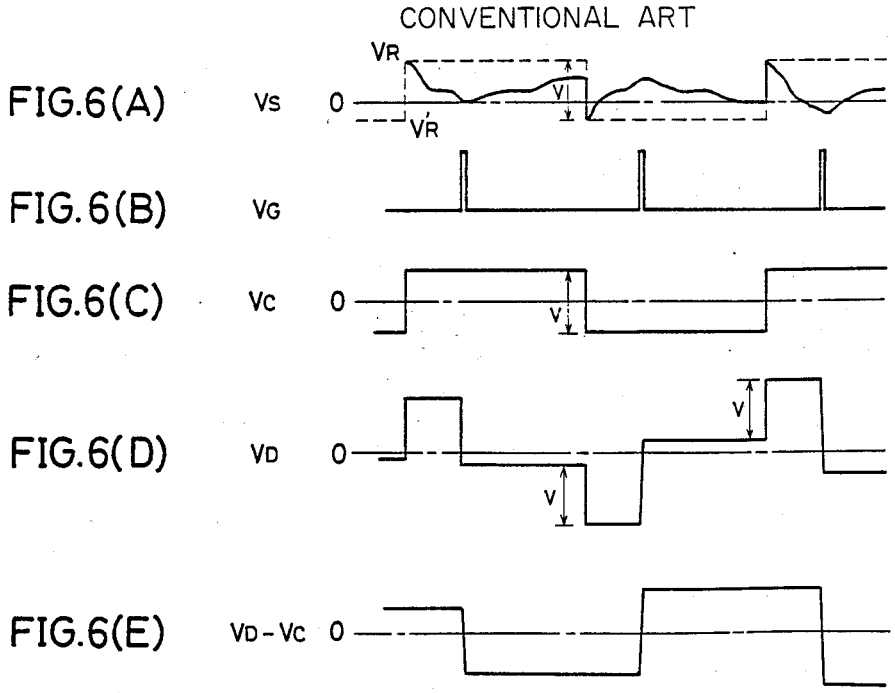

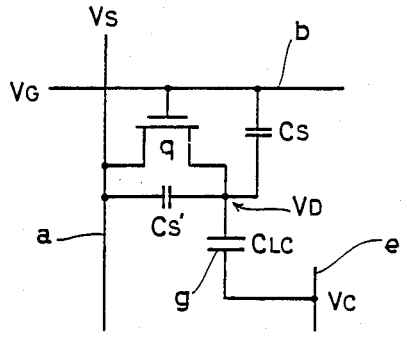
FIG.7
CONVENTIONAL ART
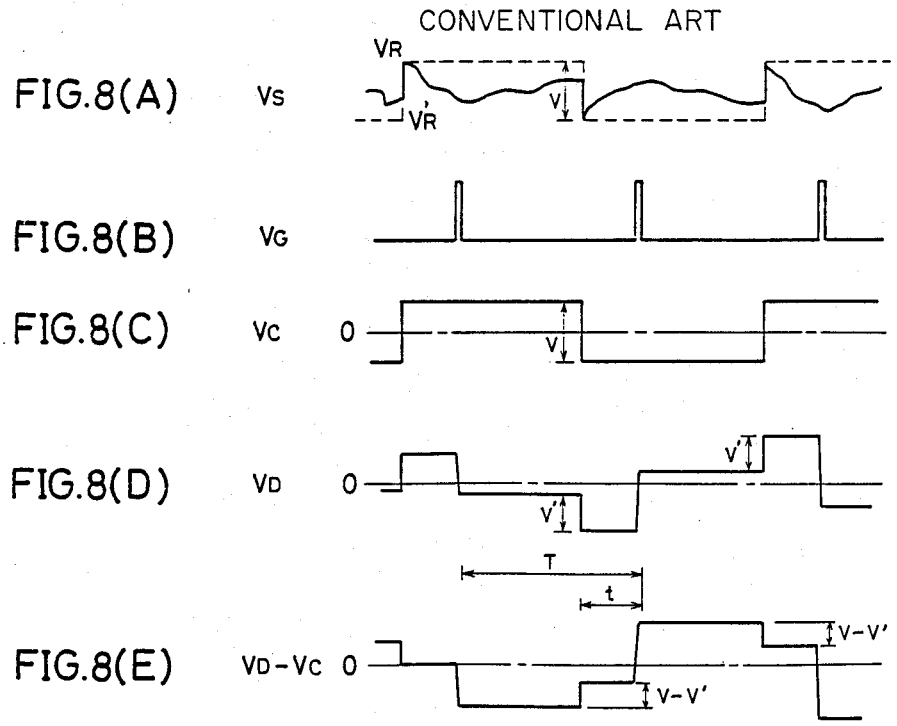

LIQUID CRYSTAL MATRIX DISPLAY DEVICE WITH POLARITY INVERSION OF SIGNAL AND COUNTER ELECTRODE VOLTAGES TO MAINTAIN UNIFORM DISPLAY CONTRAST

This application is a continuation of application Ser. No. 07,027,892 filed Mar. 19, 1987, now abandoned.

BACKGROUND OF THE INVENTION

1. Field of the Invention

The present invention relates to a matrix-type liquid crystal display device provided with switching transistors.

2. Description of Related Art

Any conventional matrix-type liquid crystal display device containing display picture elements each being provided with a switching transistor, can generate images and characters featuring sharp contrast effects, free from crosstalk, due to switching operations of the transistors. As a result, these modern matrix-type liquid crystal display devices are widely used for displaying pictures and characters in a range of pocket electronic equipment.

Typically, these matrix-type liquid crystal display devices are comprised of a first substrate (d) provided with switching transistors (q) and display picture-element electrodes (c) which are installed on respective intersections of signal electrodes (a) and scanning electrodes (b) shown in FIGS. 1 and 2, a second substrate (f) mounting counter electrodes (e) and a liquid-crystal layer (g) between the two substrates (d) and (f). The equivalent circuit and driving voltage waveforms of a display picture-element are respectively shown in FIGS. 3 and 4 (A) through (C). When the switching transistor (q) is activated by scanning signal VG which is delivered to the scanning electrode (b), a signal voltage VS applied to the signal electrode (a) charges the liquid crystal layer (g). The liquid crystal layer (g) is a capacitor CLC in the equivalent circuit. Signal voltage VS is retained in the liquid crystal layer (g) as charge until the transistor (q) is again turned ON. When the transistor (q) is again turned ON, a voltage with a polarity opposite from that of the previous scanning operation is applied to the signal electrode (a), at the same time the capacitor CLC is also charged with the voltage of opposite polarity. As a result, the liquid crystal layer (g) receives a voltage VD, thus allowing the system to generate satisfactory display characteristics equivalent to those of a static driving system.

To reduce power consumption in driving a conventional liquid crystal display device having the constitution mentioned above, a system is made available, in which the reference potential of the signal voltage to be delivered to the signal electrode (a) varies in each field synchronous with the polarity inversion, and simultaneously, rectangular waves having a specific amplitude corresponding to the variation of reference potential are delivered to the counter electrode (e) before eventually decreasing the amplitude of the signal voltage. FIG. 5 and FIG. 6 (A) through (E) represent the ideal equivalent circuit and driving voltage waveforms, respectively, related to the system mentioned above. The application of signal voltage VS to the signal electrode (a) causes the reference potential (shown by broken line in FIG. 6 (A)) to vary by amount v every field. Since the polarity simultaneously inverts, the amplitude of signal voltage VS is reduced to about one-half of the original voltage. A scanning signal VG, shown in FIG. 6 (B), is delivered to the scanning electrode (b). A counter signal VC, shown in FIG. 6 (C), is delivered to the counter electrode (e), this signal having rectangular waveforms with an amplitude v. As in the case mentioned above, this driving system also repeats operations for charging the liquid crystal layer (g) (which is represented by the capacitor CLC in the equivalent circuit) and holds the charged voltage through the transistor (g). However, when the counter signal varies by an amount corresponding to voltage v, while the transistor (q) remains OFF and the voltage is held, the potential difference between both terminals of capacitor CLC remains unchanged, thus causing voltage VD of the display picture-element electrode to merely vary by an amount v, and as a result, voltage VD eventually generates complex waveforms, as shown in FIG. 6 (D). On the other hand, voltage (VD—VC) delivered to the liquid crystal layer (g) generates the waveform shown in FIG. 6 (E), and thus, although the amplitude of the signal voltage is reduced to one-half the amplitude of the original voltage, the liquid crystal layer (g) continues to receive a voltage equivalent to that applied by the driving system mentioned earlier. When denoting the driving system mentioned above as an ideal equivalent circuit, shown in FIG. 5, providing rectangular waveforms to the counter electrode (e) effectively reduces the amplitude of signal waveforms. However, as shown in FIG. 7, stray capacitanies Cs and Cs′ are present at the periphery of the transistor (q). This generates the condition described below. When feeding waveforms VS, VG, and VC, shown in FIG. 8 (A) through (C), identical to those shown in FIG. 6 (A) through (E), to the equivalent circuit shown in FIG. 7, if the voltage waveform VC varies by an amount v while the transistor (q) remains OFF, this voltage is divided among the capacitors CLC, Cs and Cs′. As a result, the voltage VD to be delivered to the display picture-element electrode merely varies by an amount v′ ($v' < v$), and thus, complex waveforms of voltage VD are generated as shown in FIG. 8 (D). This causes the voltage (VD—VC) applied to the liquid crystal layer (g) to drop by an amount ($v - v'$) and to have the waveform shown in FIG. 8 (E) during the period (t) which lasts until the next activation of the transistor after counter signal VC is inverted. In other words, the greater the proportion of period (t) while the polarity of the opposite signal VC remains inverted against one scanning period (T), the lower the effective value of the voltage to be applied to the liquid crystal layer (g). As is clear from the above description, when this conventional driving system, which reduces the amplitude of signal voltage by feeding rectangular waveforms to the counter electrode (e), is applied to a liquid crystal display device having a stray capacitance which is substantially greater than the capacitance of liquid crystals, the display contrast is different according to the display positions of the picture elements due to timing differences between the scanning and polarity inversion processes.

OBJECT AND SUMMARY OF THE INVENTION

Object of the Invention

Accordingly, one of the essential objects of the invention is to provide a liquid crystal display device capable of generating a uniform display contrast over the entire image screen.

Other objects and further scope of applicability of the invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from the following description.

Summary of the Invention

The liquid crystal display device of the invention is a matrix-type liquid crystal display device comprising a first substrate mounting a plurality of switching transistors and display picture-element electrodes on respective crossing points of signal electrodes and scanning electrodes; a second substrate mounting counter electrodes opposite to the display picture-element electrodes; and a liquid crystal layer which is sandwiched between these two substrates. The liquid crystal display device of the invention causes the polarity of the signal voltage applied to the signal electrodes to invert at a specific period corresponding to an integer multiple of one scanning signal pulse width, and simultaneously, the device provides polarity-inversion signals to the counter electrodes, using a specific frequency identical to that of the above signal electrodes.

More particularly, the device of the invention allows the proportion of the period of polarity inversion of the counter signals against one scanning period to remain almost constant, independent of the timing of the scanning signals, by inverting the polarity of the signals to be applied to signal electrodes and counter electrodes at a specific period corresponding to an integer multiple of one scanning signal pulse width. As a result, the device of the invention generates a uniform display contrast effect over the entire image screen, even though stray capacitance of respective picture elements is substantially greater than the capacitance of liquid crystals.

BRIEF DESCRIPTION OF THE DRAWINGS

The present invention will be better understood from the detailed description given hereinbelow and the accompanying drawings which are given by way of illustration only, and thus are not limitative of the present invention in which:

FIG. 3 is a conventional simplified diagram of equivalent circuit per picture-element;

FIG. 4 (A) through (C) are respectively the driving voltage waveforms of the equivalent circuit shown in FIG. 3;

FIG. 5 is a conventional simplified diagram of an equivalent circuit per picture-element for reducing power consumption;

FIG. 6 (A) through (E) are respectively the driving voltage waveforms of the equivalent circuit shown in FIG. 5;

FIG. 7 is a conventional diagram of an equivalent circuit per picture-element when stray capacitance is present at the periphery of a transistor;

FIG. 8 (A) through (E) are respectively the driving voltage waveforms of the equivalent circuit shown in FIG. 7;

DESCRIPTION OF THE PREFERRED EMBODIMENTS

Figure 1:
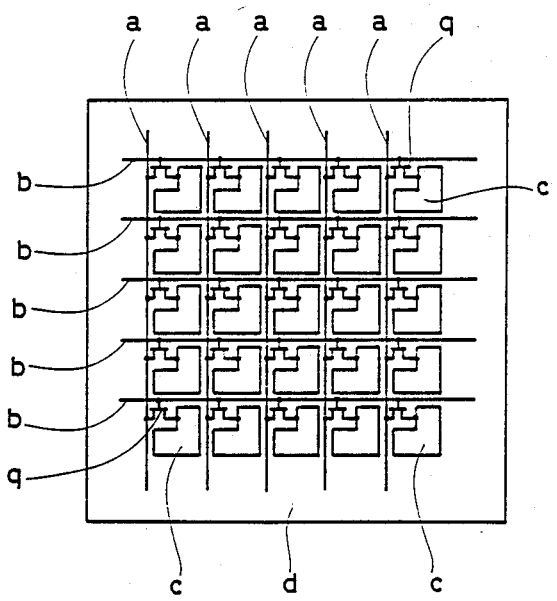
FIG.1 CONVENTIONAL ART
FIG. 1 is a conventional schematic diagram of a liquid crystal display device incorporating picture elements which are provided with switching transistors.
Figure 2:
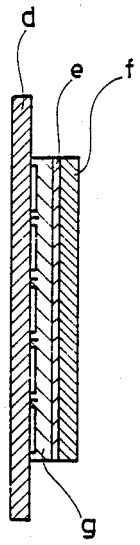
FIG.2 CONVENTIONAL ART
FIG. 2 is a sectional diagram of the liquid crystal display device shown in FIG. 1.
Figure 9:
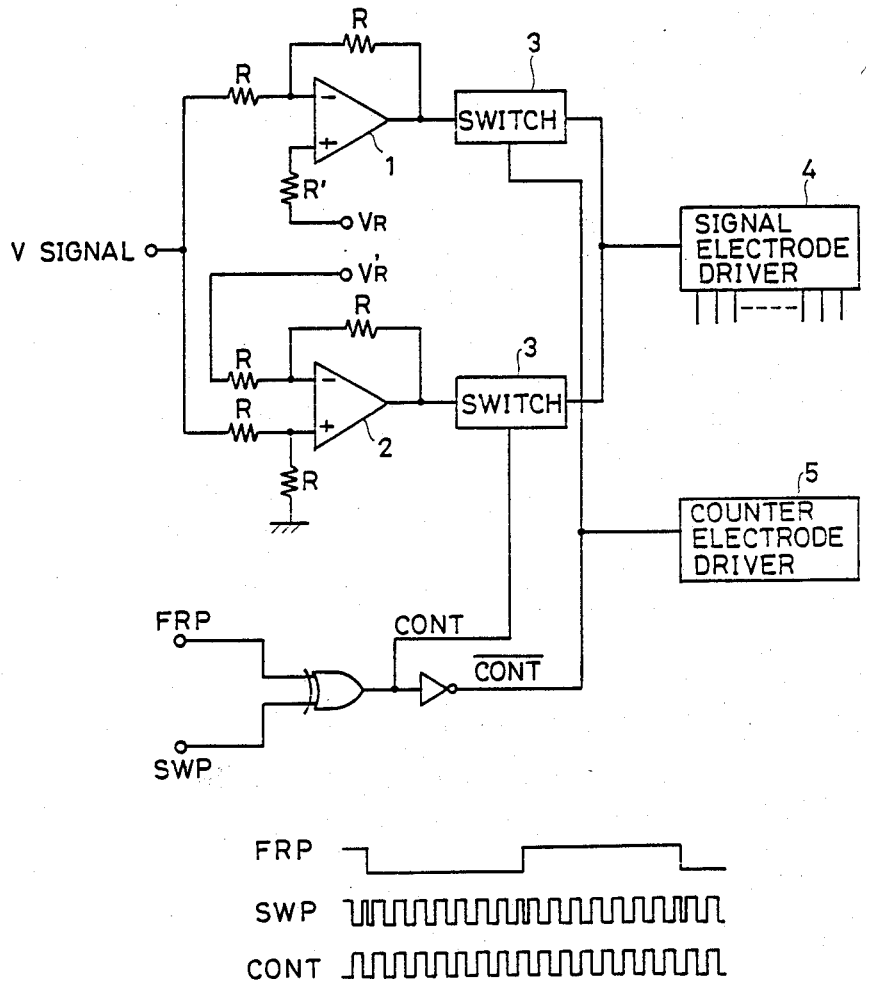
FIG. 9 is a simplified block diagram of a driving circuit generating driving voltage waveforms for the liquid crystal display device of the invention.
Figure 10:
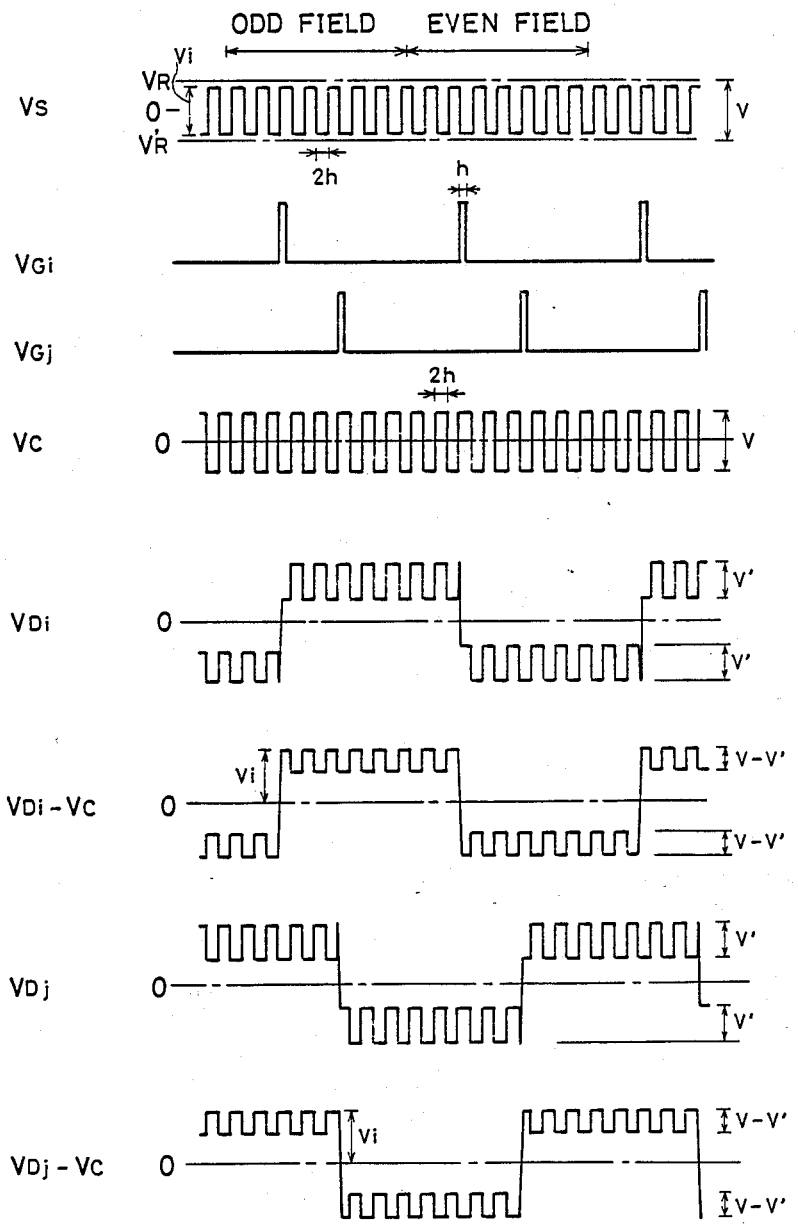
FIG. 10 is a diagram denoting examples of voltage waveforms generated by the driving circuit shown in FIG. 9.

With particular reference to FIGS. 9 and 10, one of the preferred embodiments of the invention is described below. The following description refers to the embodiment in which inversion of the polarity is executed at a specific period that is twice that of one scanning signal pulse width. See FIG. 10, in which a signal voltage waveform VS generates uniform display contrast effect over the entire image screen. Originally, waveform VS should be a rectangular waveform having amplitude 2 Vi, however, the actual amplitude is reduced to Vi by varying a reference voltage by an amount v during a specific period that is twice that of one scanning pulse (h) and simultaneously inverting its polarity. Scanning signals VGi and VGj are respectively delivered to the i-th and j-th scanning electrodes, while the polarity of counter signal Vc is inverted at a period of 2 h synchronous with signal voltage waveform VS, thus generating a rectangular waveform with an amplitude of v. Since liquid crystals are driven by AC voltage, polarities of signal waveforms VS and VC are inverted every field. VDi and VDj are voltage waveforms for the display picture elements at the i-th and j-th scanning electrodes, respectively. As is clear from FIG. 10, although waveforms VDi and VDj vary as the counter signal Vc varies by an amount v; waveforms VDi and VDj vary by an amount v' ($v' < v$) due to influence from stray capacitance. As a result, the status of voltages delivered to the liquid crystal layer of respective display picture-elements is denoted to be VDi−Vc and VDj−Vc, respectively. Taking the moment of charging as the reference, a waveform with an amplitude reduced to $v-v'$ is generated while the polarity of the counter signal Vc remains inverted, thus reducing the effective voltage being applied to liquid crystals. However, since the proportion of the period of polarity inversion of the counter signal Vc against one scanning period remains almost constant in conjunction with all the scanning electrodes, as shown in FIG. 10, if the value v', i.e., the stray capacitance is constant, it is possible for the device of the invention to generate a uniform display contrast effect over the entire image screen. When using a drive system having the constitution mentioned above, the output voltage is reduced by the influence of stray capacitance; as a whole, the amplitude of signal voltage can be reduced, so that total power consumption can eventually be reduced. FIG. 9 represents an example of a circuit realizing the driving system mentioned above. Amplifier circuits 1 and 2 generate inversion and non-inversion signals respectively and have the additional function of shifting the reference potential of signals by amounts VR and VR'. A switching circuit 3 is connected to the amplifier circuits 1 and 2. Control signal (CONT) delivers either the inverted signal or the non-inverted signal to a signal-electrode driving circuit 4. Note that control signal (CONT) constitutes the exclusive "OR" signal of the polarity switching signal (SWP) and the frame signal (FRP). A counter-electrode driving circuit 5 shifts the voltage level of the control signal for switching polarities. By feeding a signal (v signal)

corresponding to the display content to a driving circuit having the constitution mentioned above, the device related to the invention generates the driving voltage waveforms shown in FIG. 10. As is clear from the foregoing description, the preferred embodiment of a liquid crystal display device of the invention generates a uniform display contrast effect over the entire image screen with low driving voltages and minimum power consumption. As a result, the invention effectively provides an extremely useful liquid crystal display device for application to any pocket electronic equipment for example.

The invention being thus described, it will be obvious that the same may be variable in many ways. Such variations are not to be regarded as a departure from the spirit and scope of the invention, and all such modifications are intended to be included within the scope of the following claims.

What is claimed is:

1. A liquid crystal matrix display device, comprising:

a first substrate assembly including, a plurality of signal electrodes extending in a first direction, a plurality of scanning electrodes extending in a second direction perpendicular to said first direction, and a plurality of switching transistors each connected to a scanning electrode and a signal electrode at respective intersections thereof;

a second substrate assembly facing said first substrate and including a plurality of counter electrodes opposite said signal and scanning electrodes;

a liquid crystal material sandwiched between said first and second substrates;

means for applying scanning pulses to said plurality of scanning electrodes, each scanning pulse having a predetermined pulse width;

means for applying display signals to said plurality of signal electrodes, said means for applying said display signals changing the voltage polarity of said display signals during each new field to be scanned;

means for inverting the polarity of said display signals a multiple number of times during each field being scanned wherein the period of the inversion is equal to an integer multiple of said predetermined pulse width; and means for applying signals of alternating polarity to said plurality of counter electrodes in synchronism with the polarity inversion of said display signals.

2. A liquid crystal matrix display device as defined in claim 1, wherein said integer multiple is 2.

* * * * *